US006742508B2

(12) United States Patent
Kinge

(10) Patent No.: US 6,742,508 B2
(45) Date of Patent: Jun. 1, 2004

(54) IGNITION CIRCUITS

(75) Inventor: Richard Arthur George Kinge, Warwickshire (GB)

(73) Assignee: Meggitt (UK) Limited (GB)

( * ) Notice: Subject to any disclaimer, the term of this patent is extended or adjusted under 35 U.S.C. 154(b) by 0 days.

(21) Appl. No.: 10/366,079

(22) Filed: Feb. 13, 2003

(65) Prior Publication Data

US 2003/0155867 A1 Aug. 21, 2003

(30) Foreign Application Priority Data

Feb. 15, 2002 (GB) ..... 0203582

(51) Int. Cl.[7] ..... F02P 3/06
(52) U.S. Cl. ..... 123/598; 123/605
(58) Field of Search ..... 123/598, 605, 123/596; 315/209 CD, 209 SC

(56) References Cited

U.S. PATENT DOCUMENTS 4,763,045 A * 8/1988 Choi et al. ..... 315/209 SC
5,456,241 A * 10/1995 Ward ..... 123/598
5,505,175 A * 4/1996 Mai et al. ..... 123/406.64
5,531,206 A * 7/1996 Kitson et al. ..... 123/596
5,947,093 A * 9/1999 Ward ..... 123/598
5,992,401 A * 11/1999 Bylsma et al. ..... 123/596
6,584,965 B1 * 7/2003 Ward ..... 123/605

* cited by examiner

*Primary Examiner*—John Kwon

(57) ABSTRACT

An ignition circuit comprising storage means to store electrical energy, first and second switching devices, means for charging the storage means and means for switching each of the switching devices such that charge on the storage means is transferred to cause firing of an igniter in such a way that the voltage across each switching device is only a fraction of the total applied to the igniter. In this way, standard solid state switches may be employed rather than the more costly devices required to handle the full voltage to be applied to the igniter.

More than one such ignition circuit may be combined to provide a scanning multiple spark system with a plurality of igniters, each in conjunction with a pair of switching devices and means for switching each of the switching devices as described above.

22 Claims, 3 Drawing Sheets

IGNITION CIRCUITS

BACKGROUND OF THE INVENTION

This invention relates to ignition circuits.

High energy ignition systems employ a capacitor to store electrical energy which is then rapidly discharged to an igniter or spark plug to produce an intense spark sufficient to light a fuel-air mixture. A typical solid-state igniter may require up to 2000 volts to cause break-over. Once the spark has commenced, the igniter voltage collapses to near zero while a current of approximately 2000 amperes flows for the duration of the spark until the energy in the capacitor has dissipated. Normally this cycle of charging and discharging of the stored energy is repeated many times until satisfactory ignition of the fuel occurs.

Some high energy ignition systems employ a gas discharge tube, which breaks over at a point when the voltage on the charging storage capacitor reaches the desired level to 'dump' the accumulated charge into the igniter. For various technical reasons including, life expectancy, synchronisation, mechanical robustness and reliability, it is desirable to use solid state electronic switching of the discharge; the most suitable component for this is a thyristor. At present, suitable devices are not cheaply available to handle 2000 volts directly and the high currents in this application. However, devices to switch comfortably at 1000 volts are easy to obtain and are relatively low cost.

It is an object of the present invention to provide an alternative ignition circuit.

SUMMARY OF THE INVENTION

According to one aspect of the present invention there is provided an ignition circuit including storage means to store electrical energy, first and second switching devices, means for charging the storage means, and means for turning on each of the switching devices so that charge on the storage means is transferred to cause firing of an igniter in such a way that the voltage across each switching device is limited to a fraction of the total applied to the igniter. This makes it possible to use relatively inexpensive switching devices, capable of handling a moderate voltage, whilst providing the igniter with a sufficiently high voltage to cause sparking.

Preferably, the storage means comprises a double storage means and provides a reduced voltage point, compared to the total voltage applied to the igniter, which limits the voltage applied across each switching device.

The storage means preferably includes two storage capacitors. The voltage across each switching device is preferably substantially half the total voltage applied to the igniter.

BRIEF DESCRIPTION OF THE DRAWINGS

Several embodiments of ignition circuit will now be described, by way of example, with reference to the accompanying drawings, in which.

DETAILED DESCRIPTION OF THE INVENTION

Figure 1:
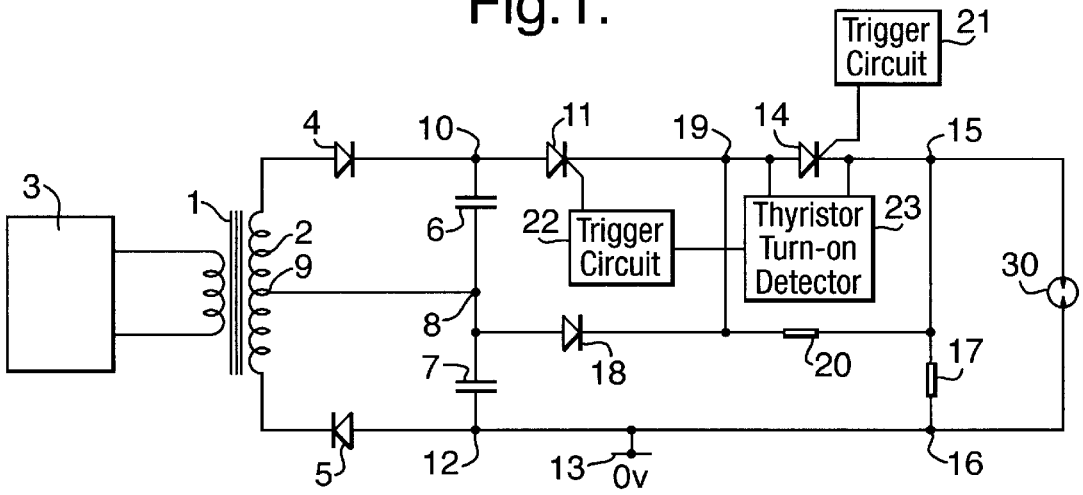
FIG. 1 is a diagram of a first embodiment of the circuit.

With reference first to FIG. 1, the circuit includes a transformer 1, with a centre tapped secondary winding 2.

The transformer 1 may be either the output transformer of a switched-mode power converter, or the secondary of a mains step-up transformer. An input supply 3 is connected to the primary winding of the transformer 1, this being current limited to prevent damage to the supply when momentary overloads are applied during the operating cycle of the system. The supply 3 preferably also has an overvoltage limit to prevent overcharge of the storage capacitors should discharge of ignition sparks not be requested or fail to occur. Two rectifier diodes 4 and 5 are connected in opposite senses to opposite ends of the secondary winding 2. The cathode and anode of the diodes 4 and 5 are connected respectively to a series connection of two storage capacitors 6 and 7, the junction 8 between the two capacitors being connected to a centre tapping 9 of the secondary winding 2. The junction 10 between diode 4 and capacitor 6 connects to the anode of a first thyristor 11. The junction 12 between the other diode 5 and capacitor 7 connects to a 0 volts reference point 13. A second thyristor 14 is connected in series between the first thyristor 11 and a first output terminal 15 of the circuit. The circuit's other output terminal 16 is connected with the 0 volts reference point 13. A resistor 17 is connected between the two output terminals 15 and 16. A high current diode 18 is connected at its anode to the junction 8 between the two capacitors 6 and 7. The cathode of the diode 18 connects both to a junction 19 between the two thyristors 11 and 12 and to one end of a resistor 20. The other end of the resistor 20 connects to a junction between the resistor 17 and the output terminal 15.

The circuit also includes a first trigger circuit 21 connected to the trigger of thyristor 14 and a second trigger circuit 22 connected to the trigger of thyristor 11. The second trigger circuit 22 is operated in response to the output from a detector 23 connected across the thyristor 14, which responds when this thyristor turns on.

The output terminals 15 and 16 of the circuit are connected across the electrodes of an igniter or spark plug 30.

The trigger circuit 21 initiates the 'request' for a spark and may be either a free-running clock oscillator producing regular thyristor gate-pulses, or a pulse shaping circuit that produces a single output pulse in response to an external timing signal to initiate a spark.

In operation, assuming both thyristors 11 and 14 are initially off (open-circuit or high impedance), the alternating output current from the transformer winding 2 charges each storage capacitor 6 and 7 through diodes 4 and 5. Typically, this voltage rises to 1000 volts on each capacitor 6 and 7 so that the voltage across their series extremities 10 and 12 is 2000 volts. The voltage across resistor 17 will be virtually zero at this time since its value is low enough to bleed away any thyristor leakage current and also the flow through the resistor 20. The small current which does flow through the resistor 20 ensures that the diode 18 is forward biased and the voltage on its cathode is therefore virtually identical to that at the junction 8 of the capacitors 6 and 7, that is, 1000 volts relative to 0 volts. By this means, the thyristors 11 and 14 have 2000 volts across them in total, but only 1000 volts across each device.

When the trigger circuit 21 requests a spark, it turns on the thyristor 14 so this becomes effectively a short circuit between its anode and its cathode. This directly connects the 1000 volts from the capacitor 7, via the diode 18 and the thyristor 14 to the igniter 30. Most igniters are unlikely to break down at this voltage so the resistor 17 provides a current path to maintain sufficient hold-on current for the thyristor 14. It can be seen that the voltage across the thyristor 11 at this time remains safely at 1000 volts. The detector circuit 23 detects when the thyristor 14 turns on from the collapse of voltage across it; this causes the trigger circuit 22 to generate a trigger pulse for the other thyristor 11. When the thyristor 11 turns on, the full 2000 volts, from the series arrangement of the two capacitors 6 and 7, is applied to the igniter 30 resulting in the initiation of a spark. The diode 18 becomes reverse biased, which prevents current flowing back into the transformer centre tap 9. The high current discharge through both thyristors 11 and 14 continues until virtually all the stored energy in the capacitors 6 and 7 is depleted and the thyristors both switch off because of the lack of hold-on current.

Since the capacitors 6 and 7 are of the same value, they tend to discharge together with only minor imbalance. However, there is always likely to be some tendency for one or other of the capacitors 6 or 7 to drain first and so exceed the zero limit and develop a reverse charge. Whilst this may not be disastrous, it puts severe strain on the associated rectifier diode 4 or 5 and in some converter circuits may cause saturation of the transformer core producing circuit failure. This effect can be reduced by adding some series resistance into the transformer secondary winding 2, or by connecting a reverse protection diode across either half of the winding to clamp any reverse swing.

It is possible that the igniter 30 will break-over and commence sparking after the turn-on of the first thyristor 14 but before the firing of the second 11. In this circuit, the resulting collapse in voltage across the capacitor 7 will simultaneously cause a step shift in the voltage at both ends of the capacitor 6, so maintaining the 1000 volts charge from the capacitor 6 across the thyristor 11, which it is able to withstand safely. Although the spark commences at an earlier point in the circuit's operation, the subsequent turn-on of the thyristor 11 still ensures that virtually all the stored energy from both capacitors 6 and 7 is available for the igniter 30.

Figure 2:
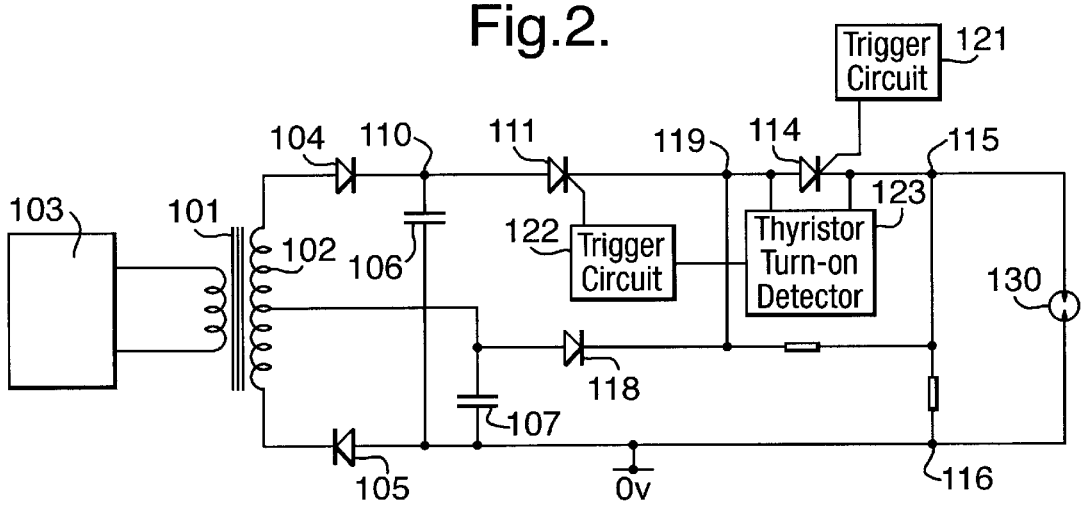
FIG. 2 is a diagram of a modified form of the circuit shown in FIG. 1.

With reference now to FIG. 2, this shows a modification of the circuit of FIG. 1, equivalent components being given the same reference number with the addition of 100.

The circuit of FIG. 2 differs from that of FIG. 1 in that capacitor 106 is connected across the 2000 volts developed in the full winding 102 of transformer 101 and that the values and voltage ratings of capacitors 106 and 107 are adjusted appropriately. Capacitor 106 now becomes the single main energy store for the circuit. Since it is operating at the 2000 volts, for a given energy capacity its size and cost may be considerably reduced compared with the dual versions previously described. The other capacitor 107 provides only the initialising voltage for the igniter 130 and reservoir for the mid-rail voltage and will typically be only between 0.5% and 1% of the capacitance value of the main capacitor 106.

In operation, assuming both thyristors 111 and 114 are off, the alternating output current from the centre tapped winding 102 of transformer 101 charges capacitor 106 to typically 2000 volts and capacitor 107 to 1000 volts through diodes 104 and 105 respectively. The series arrangement of the two thyristors 111 and 114 is subjected to the full 2000 volts from the main capacitor 106 but the voltage across each device is limited to 1000 volts as held by the voltage on the other capacitor 107.

When the trigger circuit 121 turns on the thyristor 114 this directly connects the 1000 volts at the junction 119 of the two thyristors to the igniter 130. The other trigger circuit 122 responds to breakdown of voltage across the thyristor 114 rapidly to turn on the other thyristor 111. When the thyristor 111 turns on, the full 2000 volts from the main capacitor 106 is applied to the igniter 130 resulting in the initiation of a spark. The high current discharge through both thyristors 111 and 114 continues until virtually all the stored energy in the capacitor 114 is depleted and the thyristors both switch off because of the lack of hold-on current.

With this alternative unbalanced capacitor arrangement, the voltage stress on the thyristor 111 is significantly increased if the igniter 130 discharges after the thyristor 114 turns on but before the thyristor 111 turns on. However, since the turn-on of thyristor 114 immediately 'requests' the turn on of thyristor 111, and because typical circuit resistances in leads and the like naturally cause a finite time for the voltage to increase across the main capacitor 106, it can be arranged for the 'crowbar' effect of thyristor 111 to self limit the possibility of overvoltage.

Since there is only one main energy storage capacitor in this implementation, reversal of capacitor voltage is not likely and so an extra protection diode is usually unnecessary.

Figure 3:
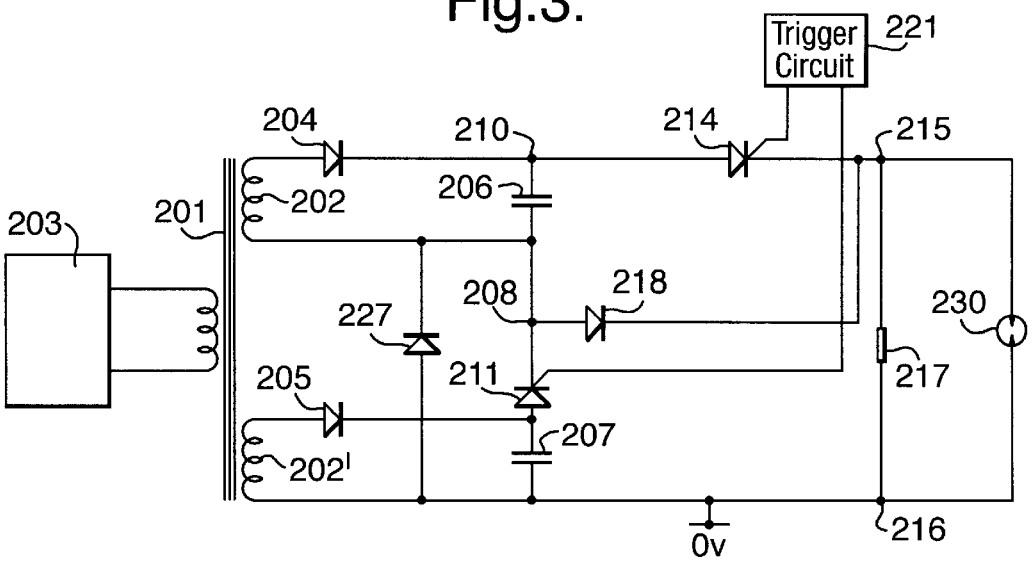
FIGS. 3 and 4 are diagrams of further embodiments of the circuit.

With reference now to FIG. 3 there is shown another modification of the circuit in FIG. 1. In this circuit equivalent components have been given the same reference number with the addition of 200.

In this circuit, the transformer 210 has two separate windings 202 and 202' in place of the single centre-tapped arrangement. Also, the thyristors 211 and 214 are not connected together directly. Instead, one thyristor 211 is connected in the series connection of the two capacitors 206 and 207 and the other thyristor 214 is connected between the terminal 210 at the end of the capacitor series and one output terminal 215. The circuit has an additional diode 227 connected across the series connection of the capacitor 207 and the thyristor 211 directly to the output terminal 215 of the circuit. These two diodes 218 and 227 enable the circuit to operate whichever thyristor 211 or 214 is fired first, thus permitting an alternative thyristor drive arrangement. By way of example, FIG. 3 shows a modified trigger circuit 221 that provides two virtually simultaneous outputs which are applied to the thyristors 211 and 214 together thus eliminating the need for a turn-on detector.

In operation, assuming that both thyristors 211 and 214 are off, the output of each transformer winding 202 and 202' will charge the associated energy storage capacitors 206 and 207 via diodes 204 and 205 respectively to 1000 volts. If, for example, thyristor 211 happens to turn on first in response to its signal from the trigger circuit 221 the 1000 volt charge on the capacitor 207 will be applied to the igniter 230 through thyristor 211 and diode 218. Normally this is not sufficient to cause break over of the igniter 230. The resistor 217 provides a path to ensure sufficient hold-on current for the thyristor 211. When the other thyristor 214 turns on, in response to its own trigger pulse from the circuit 221, the further 1000 volts charge on capacitor 206 is now added to that of capacitor 207 by nature of its series connection, thereby increasing the voltage applied to the igniter 230 to 2000 volts and initiating a spark. The high current discharge through both thyristors 211 and 214 continues until virtually all the stored energy in the capacitors 206 and 207 is depleted and the thyristors both switch off due to lack of hold-on current.

If the igniter 230 breaks over to commence sparking following the turn-on of the first thyristor 211 but before the firing of the second thyristor 214, the circuit inherently avoids subjecting the second thyristor to any increase in voltage beyond the 1000 volt level, since the voltage on the capacitor 206 is unaffected by the turn-on of the thyristor 211. If the thyristors are triggered so that thyristor 214 turns on before thyristor 211, the diode 218 will carry the initial 1000 volt application from the capacitor 206 to the igniter 230 in place of the diode 227.

Figure 4:
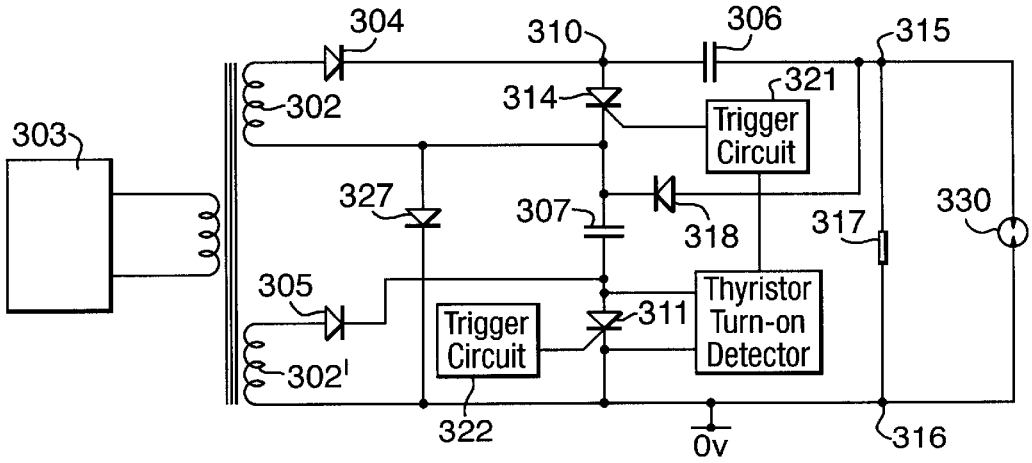

With reference now to FIG. 4, there is shown another modified circuit. In this circuit equivalent components are given the same reference number as in FIG. 1 but with the addition of 300.

This circuit has two secondary windings 302 and 302' and the two thyristors 314 and 311 are connected across respective windings via the diodes 304 and 305. One capacitor 306 is connected between the junction 310 of the diode 304 with the thyristor 313 and an output terminal 315 of the circuit. The other capacitor 307 is connected between the two thyristors 311 and 314. This circuit uses a 'shunt' method of high current switching. As in the circuits of FIGS. 1 and 3, individual storage capacitors 306 and 307 are employed at 1000 volts to govern the voltage imposed on each thyristor 311 and 314. The capacitor 306 charges through the diodes 304 and 327 whilst the capacitor 307 charges through the diodes 305 and 327. If identical value capacitors 306 and 307 are used, the diode 327 could in practice be replaced with a resistor. When the trigger circuit 322 turns on the thyristor 311, the charge on the capacitor 307 is applied to the terminal 315 through the diode 318. It should be noted that the voltage applied to the igniter 330 is negative in polarity relative to the 0 volts shown in the diagram. As before, when the thyristor 314 turns on, the additional 1000 volts on the capacitor 306 is added and applied to the igniter 330 to initiate a spark. This circuit provides the advantage that instantaneous protection may be provided against overvoltage of the transformer in the event of a disconnected or faulty igniter since triggering the thyristors will immediately clamp the winding voltages to zero. As in previous embodiments, the charging circuit associated with the transformer should be protected against over current in this condition.

Figure 5:
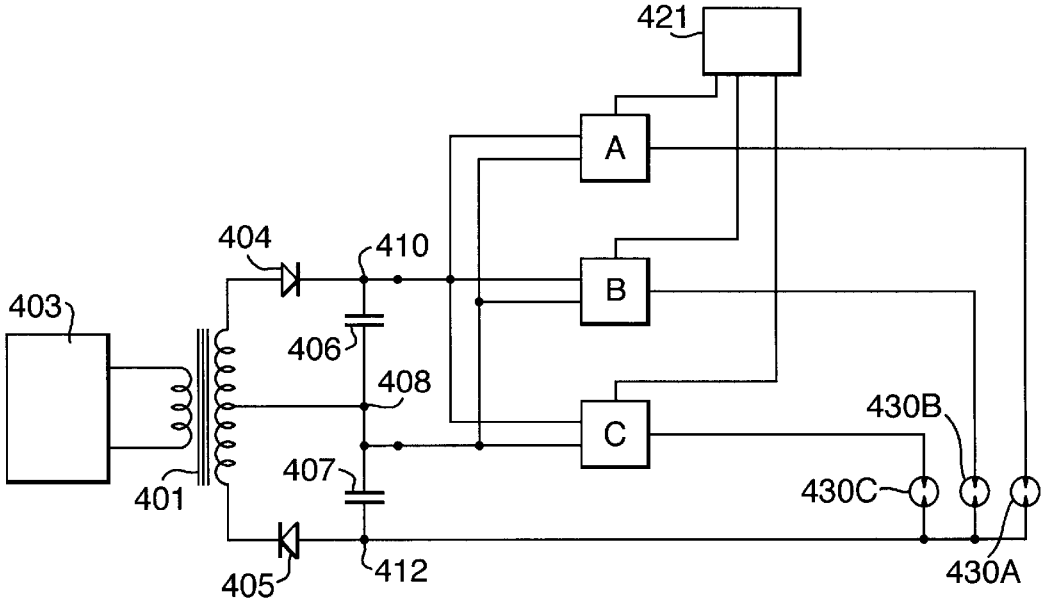
FIG. 5 is a diagram of a scanning multiple spark system employing the circuit.

FIG. 5 shows how circuits of the kind in the arrangement of FIG. 1 can be used in a scanning multiple spark system. The components in FIG. 5 equivalent to those in FIG. 1 are given the same reference number with the addition of 400. The system has a single pair of storage capacitors 406 and 407 charged via diodes 404 and 405 from a transformer 401 and power supply 403 in the same manner as in the arrangement of FIG. 1. Instead of having a single switching circuit, the system of FIG. 5 has multiple switching circuits, in this example three circuits indicated A, B and C, which switch charge from the capacitors 406 and 407 to respective ones of three different igniters 430A, 430B and 430C. Each circuit A to C has a pair of thyristors as in the arrangement of FIG. 1 but these are triggered by signals from a single trigger circuit 421 common to the three circuits A to C. The trigger circuit 421 is a scanning trigger source with an individual output for each switching circuit A, B and C. The trigger circuit 421 triggers each switching circuit A, B and C in turn, one after the other. The interval between each trigger output is chosen to be long enough to allow replenishment of the stored capacitor energy. It will be appreciated that different numbers of switching circuits could be used to fire different numbers of igniters.

The present invention enables low cost electronic switching devices to be used without risk of damage.

I claim:

1. An ignition circuit comprising storage means to store electrical energy, first and second switching devices, means for charging the storage means, and means for turning on each of the switching devices so that charge on the storage means is transferred to cause firing of an igniter in such a way that the voltage across each switching device is limited to a fraction of the total applied to the igniter.

2. An ignition circuit according to claim 1 wherein the voltage across each switching device is substantially half the total voltage applied to the igniter.

3. An ignition circuit according to claim 1 wherein the storage means comprises a double storage means and provides a reduced voltage point which limits the voltage applied across each switching device.

4. An ignition circuit according to claim 1 wherein the storage means comprises two storage capacitors.

5. An ignition circuit according to claim 4 wherein the two storage capacitors are of substantially equal capacitance.

6. An ignition circuit according to claim 4 wherein one storage capacitor is of greater capacitance than the other.

7. An ignition circuit according to claim 1 wherein the means for switching the switching devices comprises at least one trigger circuit.

8. An ignition circuit according to claim 7 wherein the trigger circuit controls the switching of both switching devices.

9. An ignition circuit according to claim 7 wherein the means for switching the switching devices comprises two trigger circuits, the first to control the first switching device and the second to control the second switching device.

10. An ignition circuit according to claim 9 wherein the means for switching the switching devices further comprises a detector circuit which detects the switching of the first switching device, thereby enabling the second trigger circuit to respond to switching of the first switching device.

11. An ignition circuit according to claim 4 which further comprises means for protecting the circuit from the adverse effects of reverse charging of the storage capacitors.

12. An ignition circuit according to claim 1 wherein the switching devices are solid state switches which, on switching on, allow current to pass through them in one direction only and which remain conductive once switched off, provided there is sufficient current passing through the switch.

13. An ignition circuit according to claim 12 wherein the solid state switches are thyristors.

14. An ignition circuit according to claim 12 which further comprises means to provide sufficient current to the solid state switches such that they remain on for a desired duration.

15. An ignition circuit according to claim 14 wherein the means to provide sufficient current to the solid state switches comprises at least one resistor.

16. An ignition circuit according to claim 13 wherein the means for switching each of the switching devices comprises free-running clock oscillators producing regular thyristor gate-pulses.

17. An ignition circuit according to claim 1 wherein the means for switching each of the switching devices comprises pulse shaping circuits which produce a single output pulse in response to an external timing signal.

18. An ignition circuit according to claim 1 further comprising at least one further pair of first and second switching devices and an igniter associated with each pair of switching devices and wherein the means for switching each of the switching devices is adapted to control all of the switching devices.

19. An ignition circuit according to claim 18 wherein the means for switching each of the switching devices comprises one trigger circuit.

20. An ignition circuit according to claim 19 wherein the trigger circuit is a scanning trigger source with an individual output for each pair of switching devices.

21. An ignition circuit according to claim 2 wherein the storage means comprises a double storage means and provides a reduced voltage point which limits the voltage applied across each switching device.

22. An ignition circuit according to claim 13 which further comprises means to provide sufficient current to the solid state switches such that they remain on for a desired duration.

* * * * *